US005399071A

United States Patent [19]

Abraham et al.

[11] Patent Number: 5,399,071

[45] Date of Patent: Mar. 21, 1995

[54] PRESSURE BOOSTER

[76] Inventors: Moshe Abraham, Mobile Post Ephraim 44830, Shilo; Zeev Stahl, 41 Netiv Hamazalot Street, Pisgat Zeev, Jerusalem, both of Israel

[21] Appl. No.: 204,235

[22] PCT Filed: Apr. 6, 1993

[86] PCT No.: PCT/US93/03311

§ 371 Date: Mar. 4, 1994

§ 102(e) Date: Mar. 4, 1994

[87] PCT Pub. No.: WO93/20350

PCT Pub. Date: Oct. 14, 1993

[30] Foreign Application Priority Data

Apr. 7, 1992 [IL] Israel ..... 101516

[51] Int. Cl.[6] ..... F04B 17/00

[52] U.S. Cl. ..... 417/225; 91/345; 91/346; 60/563

[58] Field of Search ..... 417/225, 377, 391, 395, 417/401, 226; 91/344, 345, 346; 60/563, 486

[56] References Cited

U.S. PATENT DOCUMENTS 1,451,303 4/1923 Mitchell .
2,896,542 7/1959 Forghieri .
2,973,717 3/1961 Kendig .
3,086,470 4/1963 Skipor et al. .
3,407,601 10/1968 Beck ..... 417/226
3,544,239 12/1970 Graham .
3,589,839 6/1971 Johnson ..... 91/347
3,787,147 1/1974 McClockin et al. ..... 60/547
3,981,148 9/1976 McLuckie ..... 60/562
4,172,698 10/1979 Hinz et al. ..... 91/346
4,627,794 12/1986 Silva ..... 417/225
4,674,958 6/1987 Igarashi et al. ..... 417/225
4,879,943 11/1989 Grach ..... 91/346

*Primary Examiner*—Thomas E. Denion
*Attorney, Agent, or Firm*—Browdy and Neimark

[57] ABSTRACT

A liquid pressure booster includes a head member with a low-pressure inlet connectable to a liquid source at mains pressure, a high-pressure outlet connectable to the object to be tested, and a central bore, a compound cylinder constituted by a first, upper, relatively small-diameter portion fluid-tightly attached to the head member and a second, lower, relatively large-diameter portion contiguous with the upper portion and closed off at its lower end by a bottom plate having a drain opening. The booster further includes a hollow compound piston having two active portions: a first portion fitting, and movable in, the first cylinder portion, and a second portion, contiguous with the first portion, fitting, and movable in, the second cylinder portion, a central valving bar movable in reciprocating translation between first and second positions, a bistable valving sleeve movable between first and second positions, a first spring for biasing the compound piston towards the bottom plate and a second spring for producing a snap-action impulse causing the bistable valving sleeve to alternate between the first and second positions.

14 Claims, 7 Drawing Sheets

PRESSURE BOOSTER

The present invention relates to a pressure booster for converting a relatively low input pressure from a pressure source into a relatively high output pressure.

Before being approved for use, pressurized installations, or parts thereof, have to be tested not only at their rated pressures, but at pressures higher at least by the safety factors set for particular pieces of equipment. While factories producing certain discrete pieces of equipment reaction vessels, boilers, tanks and the like-obviously have in-house facilities for testing, other products must be tested after assembly-or repair-in the field. Such items include, e.g., sections of pipe lines, radiators, etc.

For this purpose, there exist mobile pressure generators operated either manually or electrically. The former are bulky and relatively heavy, and-involve a considerable physical exertion. The latter obviously need a power source which, under field conditions, is not readily available.

It is one of the objectives of the present invention to overcome the drawbacks and disadvantages of the prior art pressure boosters and to provide a pressure booster that uses line pressure as primary pressure source; that is light-weight and thus easily moved; and that, being manually operated, requires no electric power source, yet demands no physical effort beyond the shifting of a valving grip.

According to the invention, this is achieved by providing a liquid pressure booster comprising a head member with a low-pressure inlet connectable to a liquid source at mains pressure, a high-pressure outlet connectable to the object to be tested, and a central bore; a compound cylinder constituted by a first, upper, relatively small-diameter portion fluid-tightly attached to said head member and a second, lower, relatively large-diameter portion contiguous with said upper portion and closed off at its lower end by a bottom plate having a drain opening; a substantially hollow compound piston having two active portions: a first, relatively small-diameter portion fitting, and movable in, said first cylinder portion and adapted, when acting, to produce a relatively high pressure, and a second, relatively large-diameter portion, contiguous with said first portion, fitting, and movable in, said second cylinder portion, and adapted to be acted upon by a relatively low pressure; a central, at least partly hollow, valving bar actuatable from outside of said head member and movable in reciprocating translation between a first and a second position; a bistable valving sleeve slidably seated on said valving bar and movable in reciprocating translation between a first and a second position; first spring means for biasing said compound piston towards said bottom plate; second spring means for producing a snap-action impulse causing said bistable valving sleeve, in dependence of, and in coordination with, the movement of said compound piston, to alternate between said first and said second positions.

The invention further provides a liquid pressure booster comprising a head member with a low-pressure inlet socket connectable to a liquid source at mains pressure, and a high-pressure outlet socket connectable to the object to be tested; a compound cylinder constituted by a first, relatively small-diameter portion and a second, two-part, relatively large-diameter portion, the upper one of said two parts carrying said head member to which said first, small-diameter portion is tightly attached, the lower one of said two parts having a bottom surface; a compound piston constituted of two active portions: a first, substantially hollow, relatively small-diameter portion fitting, and slidable in, said first cylinder portion, and a second, relatively large-diameter portion movable in said second cylinder portion, with the large-diameter piston portion dividing said second, large-diameter cylinder portion into a pressurizable chamber on the one hand, and into a vented chamber communicating with the atmosphere, on the other; first valve means located on top of said head member and having at least two discrete, optional positions, in the first of which positions it connects said low-pressure inlet socket via said high-pressure outlet with said object to be pressure-tested to the exclusion of said compound cylinder, and in the second of which positions it connects said low-pressure inlet socket with said pressurizable chamber; second, bistable valve means mounted on said large-diameter portion of said compound piston and flippable between a first position and a second position; first flexible ducting means connecting said low-pressure inlet socket with an inlet port of said second valve means, and second flexible ducting means connecting an outlet port of said second valve means with the atmosphere.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the drawings:

Figure 1:
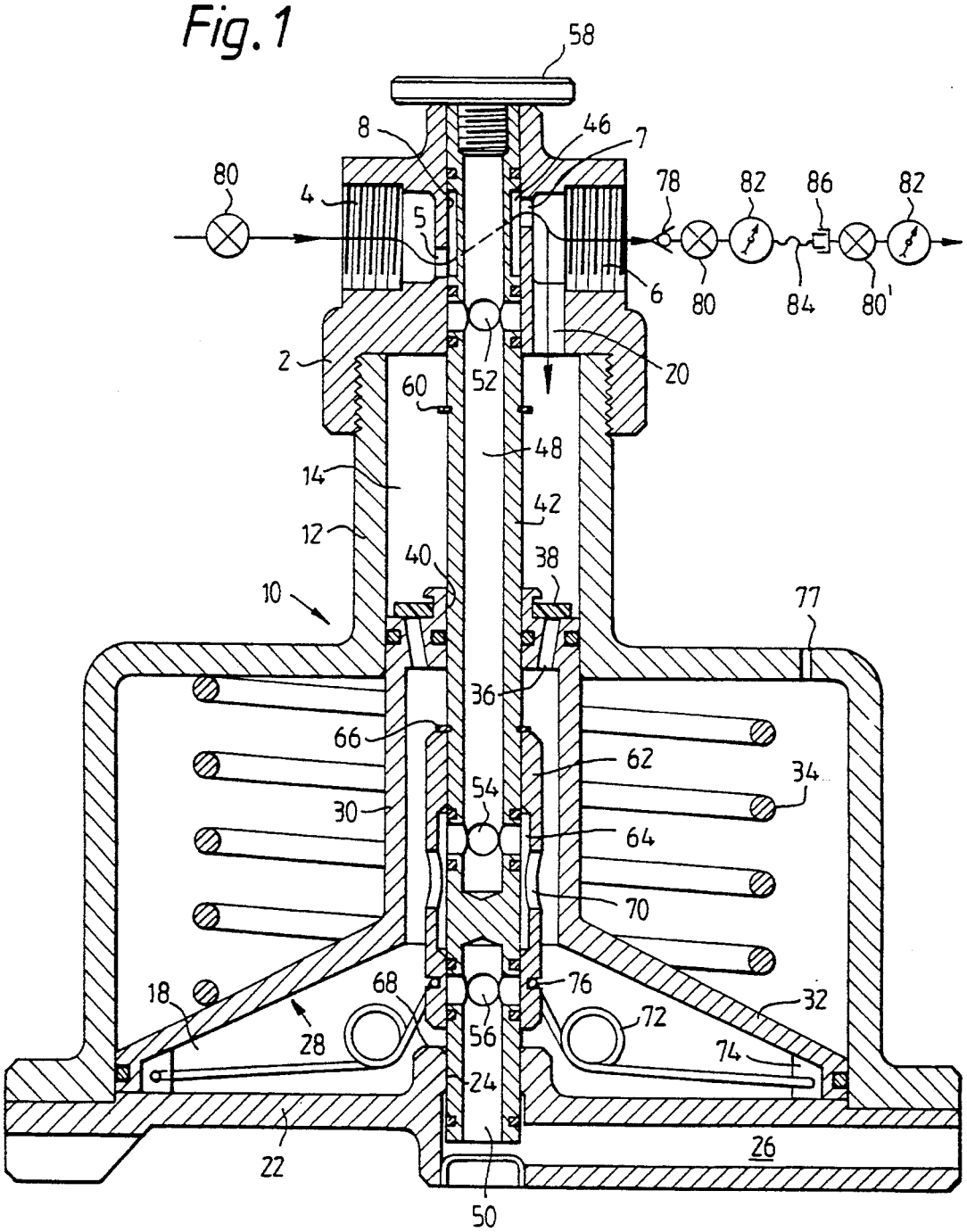
FIG. 1 is a cross-sectional view of the pressure booster according to the invention, showing it in the priming stage.

Referring now to the drawings, there is seen in FIG. 1 a head member 2 having a low-pressure (LP) inlet socket 4 to be connected to a source at mains pressure, and including a port 5, and a high-pressure (HP) outlet socket 6 to be connected to the object to be tested, and including a port 7. Also seen is a central bore 8.

There is further shown a compound cylinder 10 consisting of an upper, relatively small-diameter portion 12 to which is fluid-tightly attached head member 2, defining a high-pressure (HP) space 14, and of a lower, relatively large-diameter portion 16 contiguous with upper cylinder portion 12, defining with a piston unit to be described further below, a low-pressure (LP) space 18.

The HP space 14 communicates with HP outlet 6 via a duct 20.

The lower compound cylinder portion 16 is closed off at its lower end by a bottom plate 22 having a plugged-up central bore 24, from which a radial drain duct 26 leads to the free atmosphere.

Inside compound cylinder 10 there is seen a substantially hollow compound piston 28, comprised of an upper, relatively small-diameter portion 30 fitting, and movable in, the upper cylinder portion and adapted, when acting, to produce in HP space 14 a relatively high pressure, and a lower, relatively large-diameter portion 32 which, in a manner to be explained further below, is acted upon by the relatively low pressure from LP inlet 4 to the effect of pushing compound piston 28 upwards against the restoring force of a helical spring 34.

The upper portion 30 of compound piston 28 is provided with a plurality of substantially axial holes 36, through which LP space 18 can communicate with HP space 14. On the HP side, these holes are covered by a flap valve 38, which serves as a check valve: liquid is permitted to pass from LP space 18 into HP space 14, but not the other way round. The reason for this will become apparent further below.

Surrounded by axial holes 36, there is seen a central bore 40, aligned with bore 8 in head member 2 and bore 24 in bottom plate 22.

These three central bores accommodate a slidable relying bar 42 extending from the upper end of head member 2 right into bore 24 of bottom plate 22.

Figure 2:
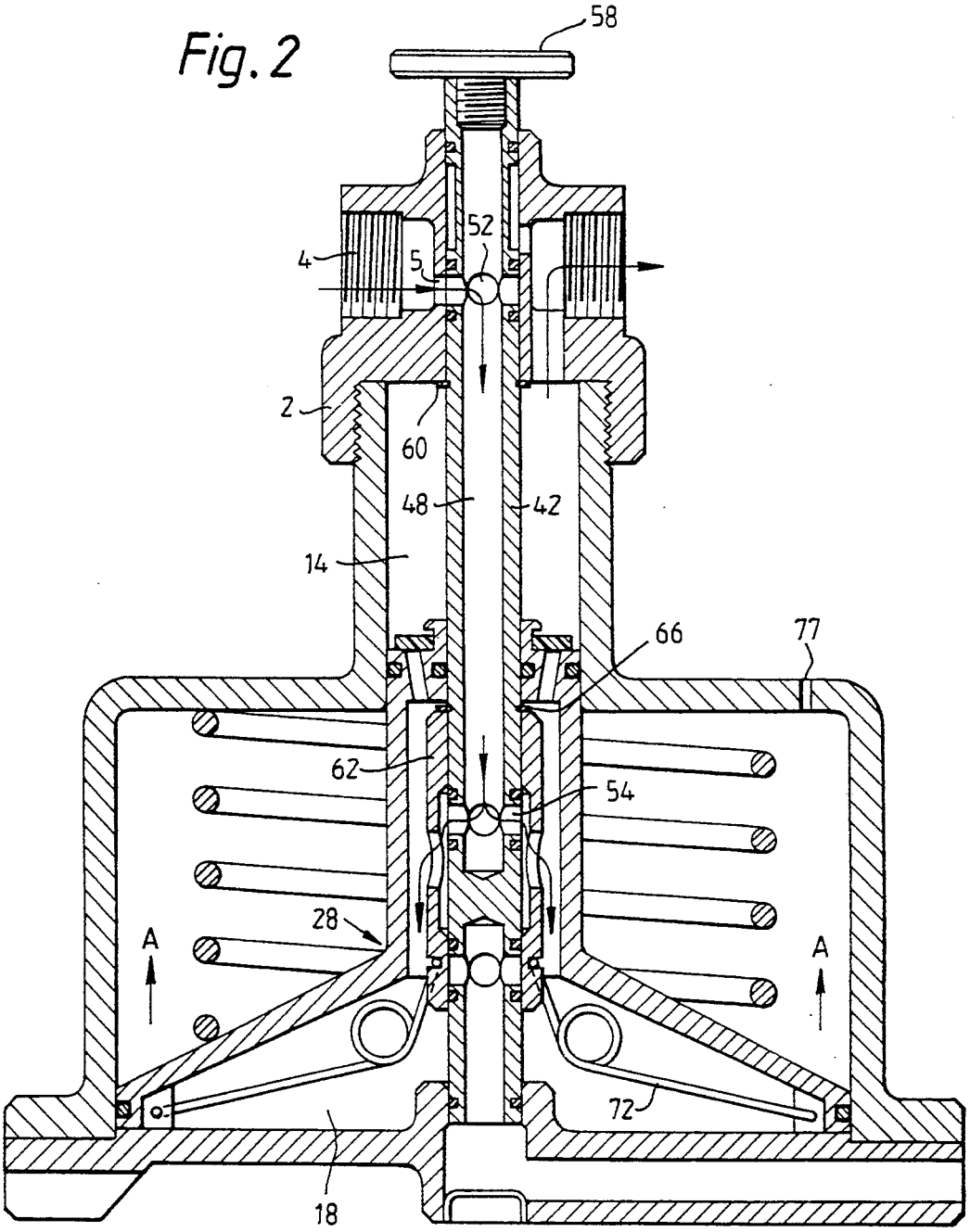
FIG. 2 shows the initial condition of the booster after the operating grip has been pulled.
Figure 3:
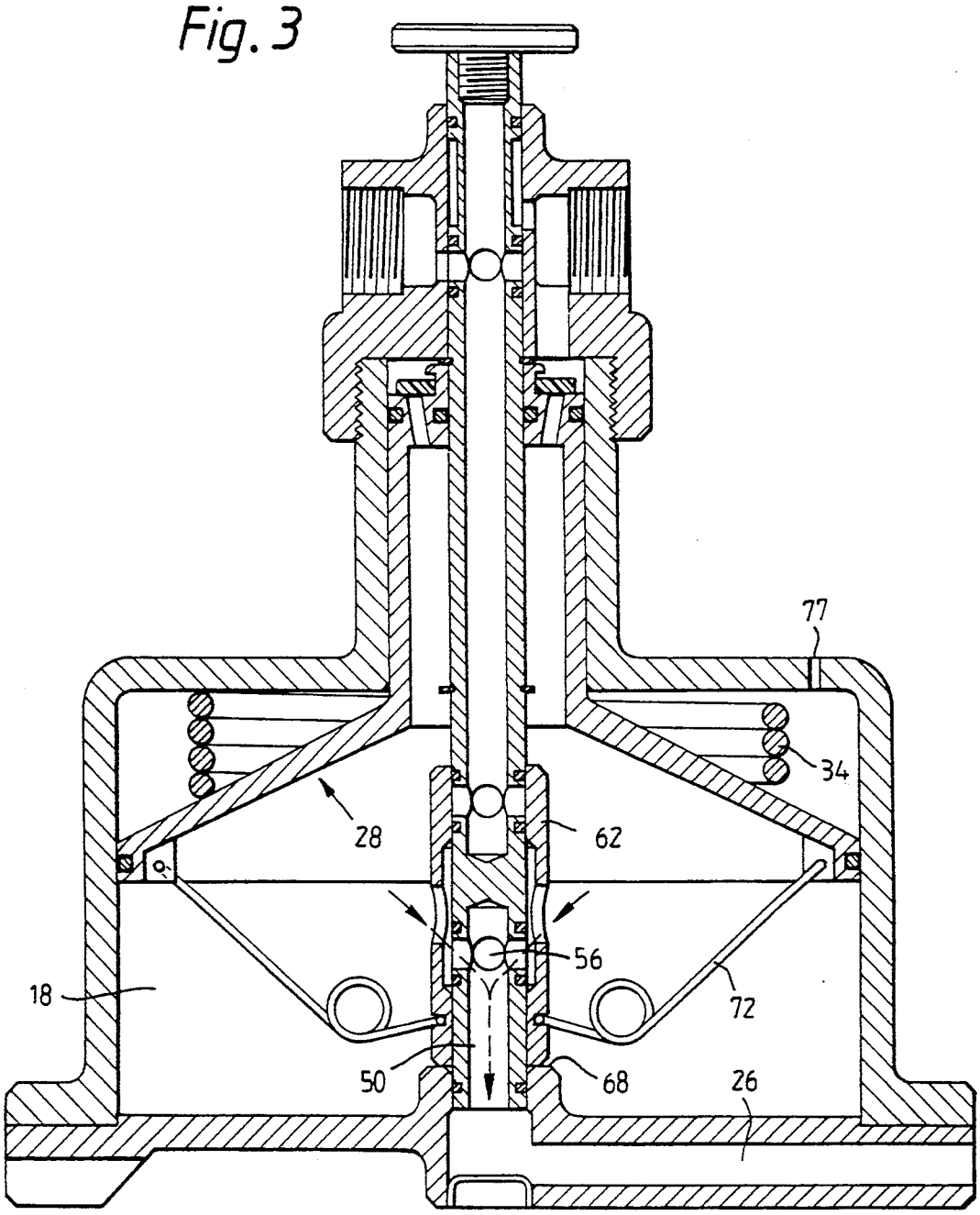
FIG. 3 shows the next stage, in which the piston has reached the end of its effective stroke and the drain has been opened.
Figure 4:
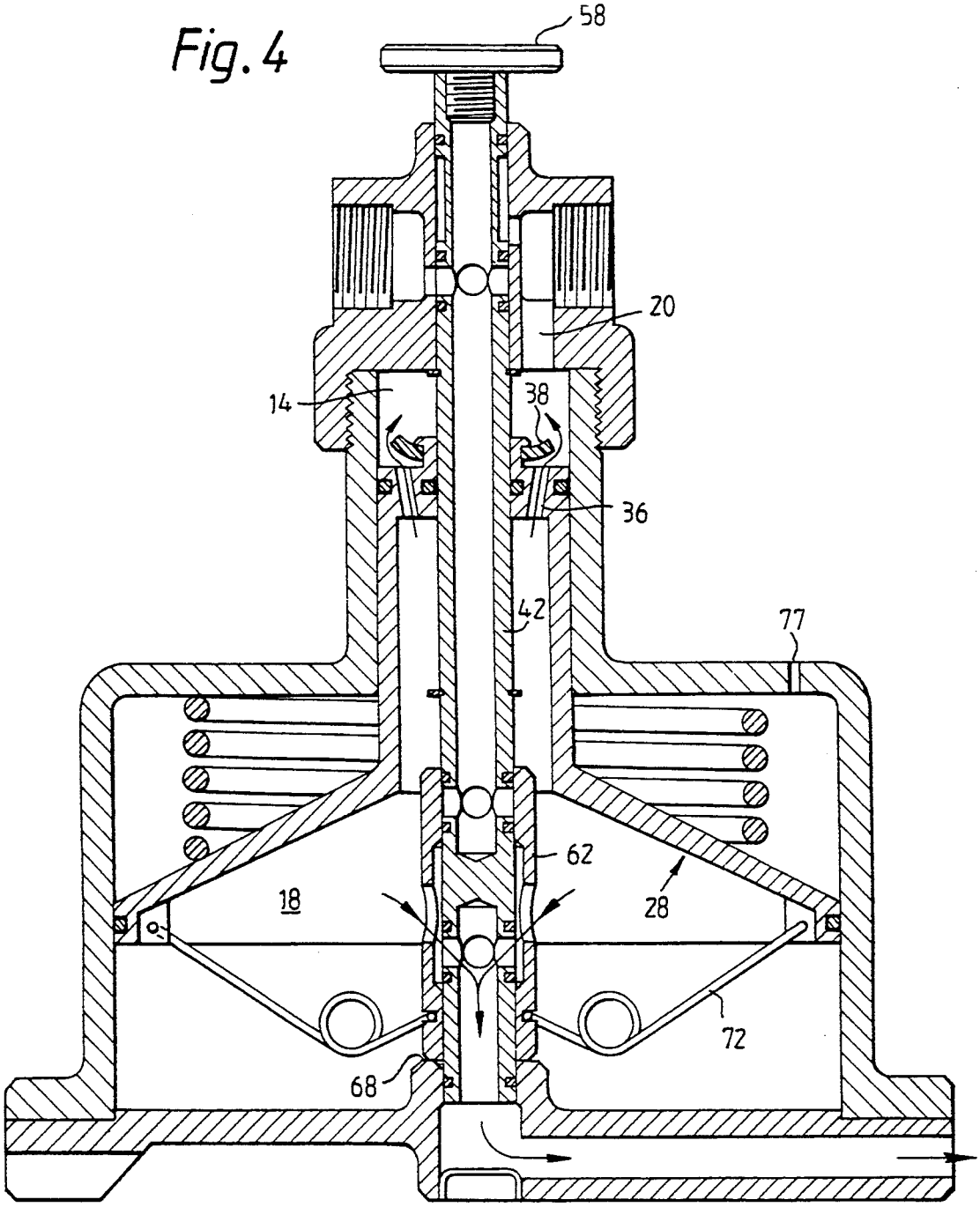
FIG. 4 shows the compound piston in the middle of its return stroke, with the flap valve open.

Close to its upper end, valving bar 42 is provided with a circumferential recess 44 which, together with bore 8, defines an annular space 46. Further provided are two non-communicating axial bores 48 and 50, with inlet ports 52 and outlet ports 54 in the former, and outlet port 56 in the latter. The upper end of bore 48 is closed by a handling grip which also serves as an abutment defining the lower of two positions which valving rod 42 may assume. The upper position is illustrated in FIGS. 2, 3 and 4, and is defined by upper abutment ring 60.

On the lower portion of the relying rod is slidably mounted a valving sleeve 62, a peripheral recess in the central bore of which defines, together with rod 42, an annular space 64. The sleeve 62 can assume two positions relative to relying rod 42, the upper one of which is defined by an abutment ring 66 mounted on rod 42 and the lower one, seen in FIGS. 3 and 4, being defined by a central boss 68 of bottom plate 22. Also seen are circumferentially located inlet ports 70.

There are further provided a plurality of two-armed torsion springs 72, the respective ends of which are articulated, on the one hand, to lugs 74 integral with the lower end of piston portion 32 and, on the other hand, in grooves 76 in sleeve 62. The springs 72 are so configured that when, due to piston movement, their lug-sided ends move up or down beyond a certain threshold position, they "snap through", rapidly shifting the valving sleeve 62 from one to the other of its definite positions along valving rod 42, and thereby, as will be shown, controlling liquid flow and, thus, piston movement.

An air vent 77 connects the non-active cylinder volume above piston portion 32 with the atmosphere.

"Peripherals" located between the pressure booster according to the invention and the object to be tested, include: a non-return valve 78 shut-off valves 80 80' pressure gauges 82, a flexible pipe line 84, a self-sealing coupling 86, and (not shown) a safety valve to protect the test object against excessive pressures.

Watertightness, wherever required (at the piston portions, around the ports, etc.) is ensured by the use of O-rings.

The following explains the operational sequence of the device:

FIG. 1 shows the device in the priming stage. The inlet 4 having been connected to the low-pressure line and all valves 80 having been opened, water enters through inlet socket 4 and port 5, passes annular space 46 and, through port 7, enters outlet socket 6, where part of the flow passes through duct 20, filling space 14. The main flow passes the peripherals 78–82 and enters, and fills, the object to be tested. Once the latter has been filled, operation can begin, initiated by pulling up the grip 58 until abutment ring 60 of valving bar 42 hits the lower face of head member 2 (see FIG. 2). This upward movement of bar 42 has two immediate effects: it brings inlet ports 52 into alignment with inlet port 5 of head member 2, permitting water to enter axial bore 48, as shown by the heavy solid lines. At the same time, abutment ring 66, too, has moved up, permitting springs 72 to straighten out slightly by pushing up valving sleeve 62, thereby maintaining its position relative to rod 42. In this position, the outlet ports 54 of rod 42 are located within annular space 64 of sleeve 62, and the water, as indicated, can enter LP space 18 and start pushing compound piston 28 up in the direction of arrows A, thereby obviously displacing the water in (previously filled) HP space 14 and forcing it into the object to be tested. At the same time, helical spring 34 is compressed (FIG. 3).

At about the time that compound piston 28 has reached its uppermost position, torsion springs 72 have attained their threshold position at which the downward-acting vertical component applied at groove 76 has become stronger than the frictional resistance of sleeve 62, and snap through, flipping sleeve 62 from its upper position in FIG. 2 to its lower position in FIG. 3, in which the inlet ports.56 are located within annular space 64 of sleeve 62. The return spring, previously compressed, can now start to re-expand, pushing compound piston 28 down again and, from that moment on, expelling the water from LP space 18 through bore 50 and drain duct 26 into the atmosphere, as indicated by the broken flow lines in FIG. 3.

FIG. 4 shows the compound piston 28 on its way downward, i.e., performing its return stroke. However, because of the provision of non-return valve 78 on the way to the test object (see FIG. 1), no water can return into high-pressure space 14 through duct 20. That is why the water required to fill the now-expanding space 14 is drawn from space 18 through holes 36, lifting on its way flap valve 38, as clearly indicated.

At the end of the return stroke, springs 72 snap through again, flipping sleeve 62 to its upper position and thus recreating the situation depicted in FIG. 2, when low-pressure water can enter space 18, restarting the cycle described.

Operation is continued until the required test pressure has been achieved. To terminate operation, all that is required is to push grip 58 down again. This restores the situation shown in FIG. 1, when inlet ports 52 of valving rod 42 are out of alignment with inlet port 5 of head member 2, cutting off any water inflow. The valve 80' is then closed and the device removed, leaving the test object under pressure for as long as required.

Figure 5:
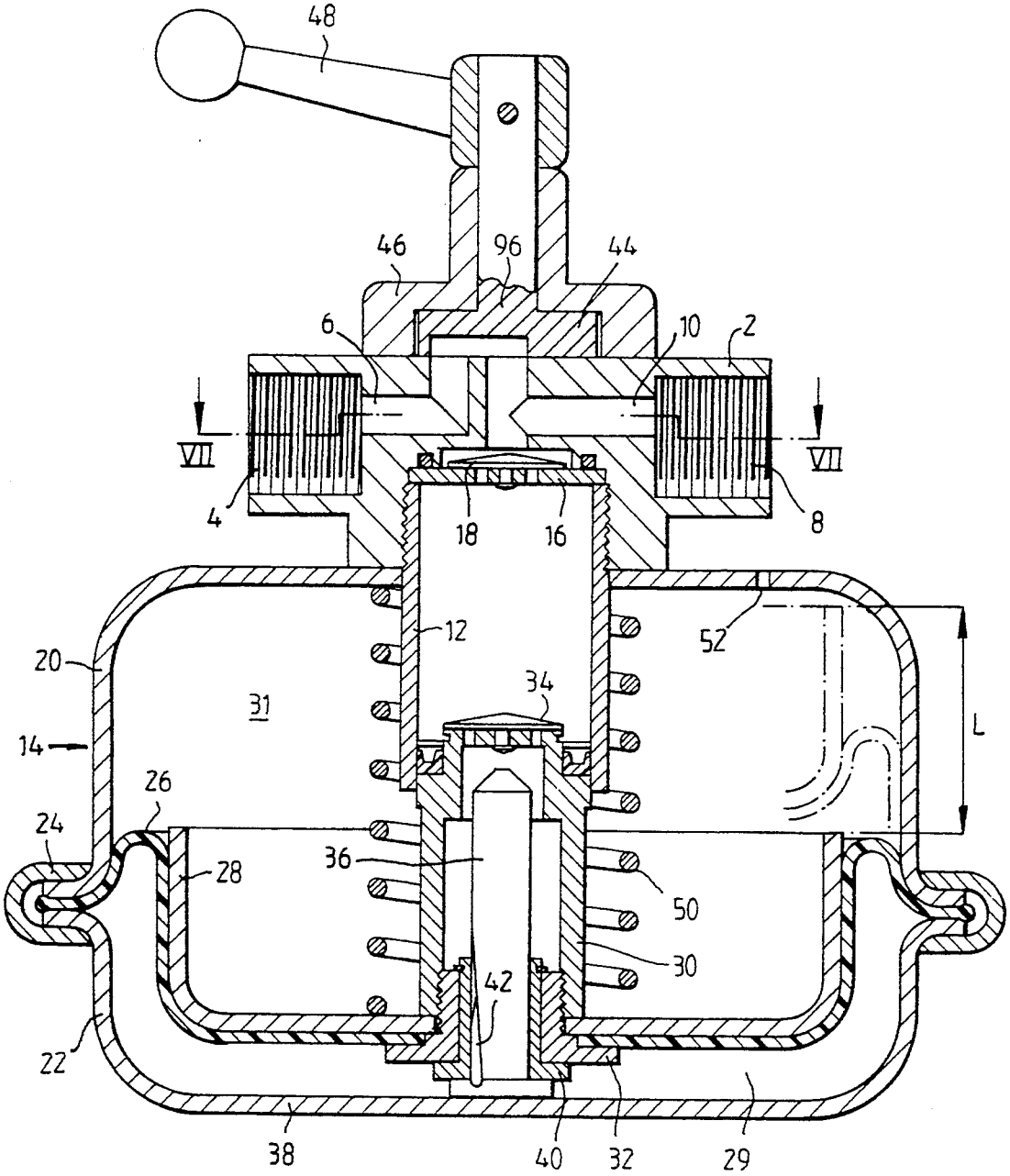
FIG. 5 is a view of an additional embodiment of the invention, in cross-section along plane V-V in FIG. 7.

Another embodiment of the invention is shown in FIGS. 5–9. There is seen in FIG. 5 a head member 2 having a low-pressure inlet socket 4 to be connected to a liquid source at mains pressure and including a port 6, and a high-pressure outlet port 8 to be connected to the object to be tested (not shown) and including a port 10.

The head member 2 is mounted on a compound cylinder constituted by a first, relatively small-diameter portion 12 and a second, two-part, relatively large-diameter portion 14, with the first cylinder portion 12 tightly screwed into head member 2, its upper end being closed by a plate 16 carrying a check valve 18, permitting fluid flow only from first cylinder 12 into the head member, but not the other way round.

The two-part, large-diameter portion 14 of the compound cylinder is seen to include an upper part 20 which carries head member 2, and a lower part 22. The upper and lower parts are joined by a swaged ring 24, tightly clamping between them the effective large-diameter portion of a compound piston system, which, in this embodiment, is a rolling diaphragm 26, stabilized by a metallic piston former 28.

The rolling diaphragm 26 defines, together with lower part 22 of the large-diameter portion 14 of the compound cylinder, a pressurizable chamber 29, and together with upper part 20 of cylinder portion 14, a vented chamber 31 communicating with the atmosphere.

The small-diameter portion 30 of the compound piston system is mounted on the inside bottom surface of piston former 28 with the aid of hub member 32. Piston portion 30 is hollow and slidingly fits small-diameter portion 12 of the compound cylinder system described above. On its top, piston portion 30 carries a check valve 34, which permits liquid flow from piston portion 30 into cylinder portion 12, but prevents flow in the opposite direction.

Further seen is a guide pillar 36 fixedly attached to bottom surface 38 of the lower part 22 of large-diameter cylinder portion 14. The guide pillar 36 slidingly fits a control sleeve 40, which in its turn is rotatably retained in hub member 32. The guide pillar 36 has two tasks: it guides and stabilizes rolling diaphragm 26 and piston former 28 in their reciprocating movement, and it imparts a limited reciprocating rotary movement to control sleeve 40, for a purpose to be explained further below. The rotary movement is produced by a helical groove 42 provided in pillar 36 (see also FIG. 6) and a pin (not shown), one end of which projects into groove 42, the other end of which is fixedly attached to control sleeve 40. Up and down movement of the piston unit relative to stationary guide pillar 36 and its helical groove 42, causes the pin riding in helical groove 42 to impart to sleeve 40 a reciprocating rotary movement of,limited angular extent.

Also seen in FIG. 5 is a first, rotary valve 44 seated in a valve housing 46 mounted on head member 2 and manually operated with the aid of handle 48.

The helical spring 50 biases rolling diaphragm 26 and piston former 28 towards the bottom 38 of cylinder portion 14.

An air vent 52 connects upper part 20 of large-diameter cylinder portion 14 with the atmosphere, thus allowing the air in upper part 20 to be expelled during the upward stroke of the piston system and to be readmitted during the return stroke.

Figure 6:
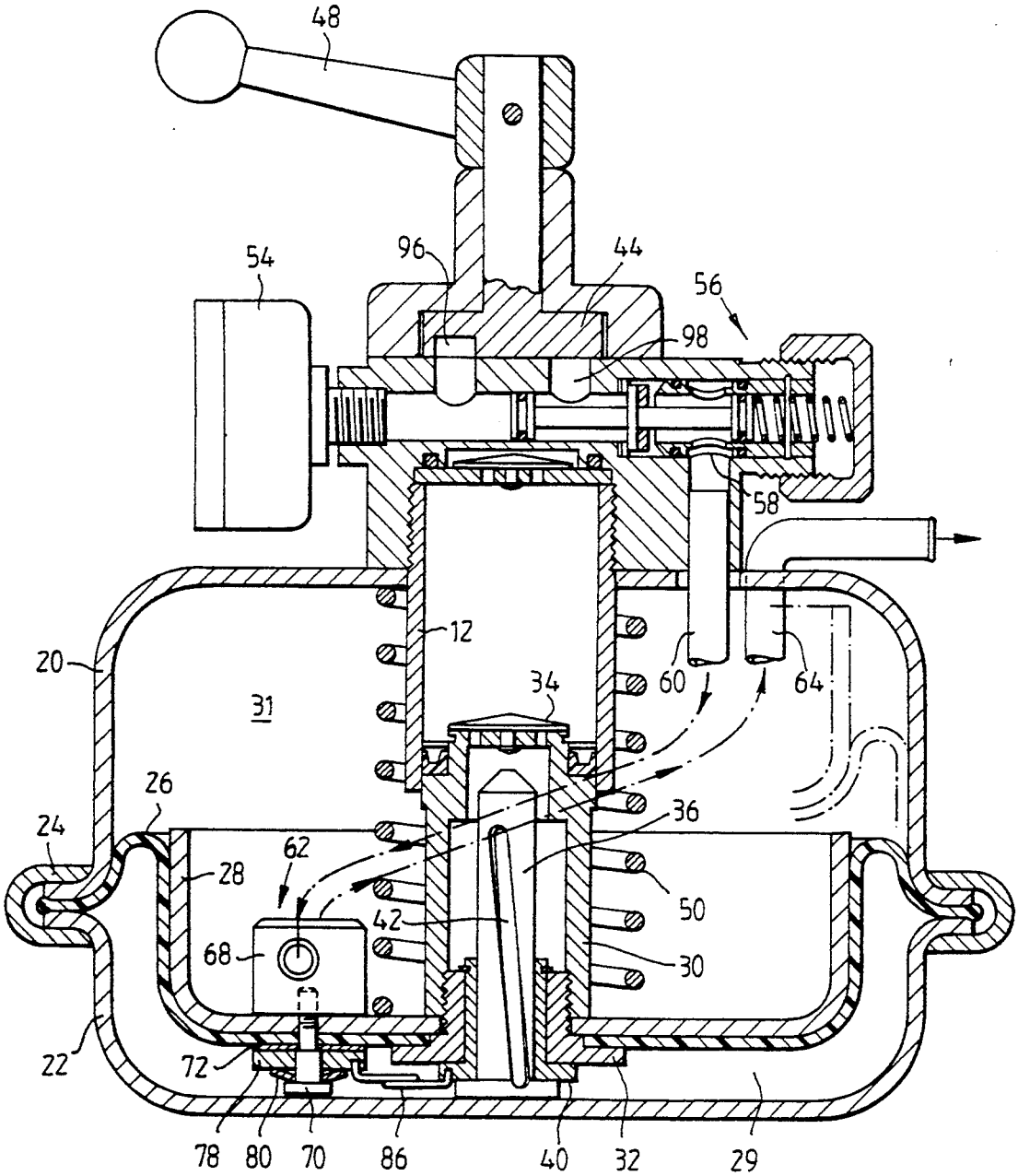
FIG. 6 is a similar view, in cross-section along plane VI-VI in FIG. 7.
Figure 7:
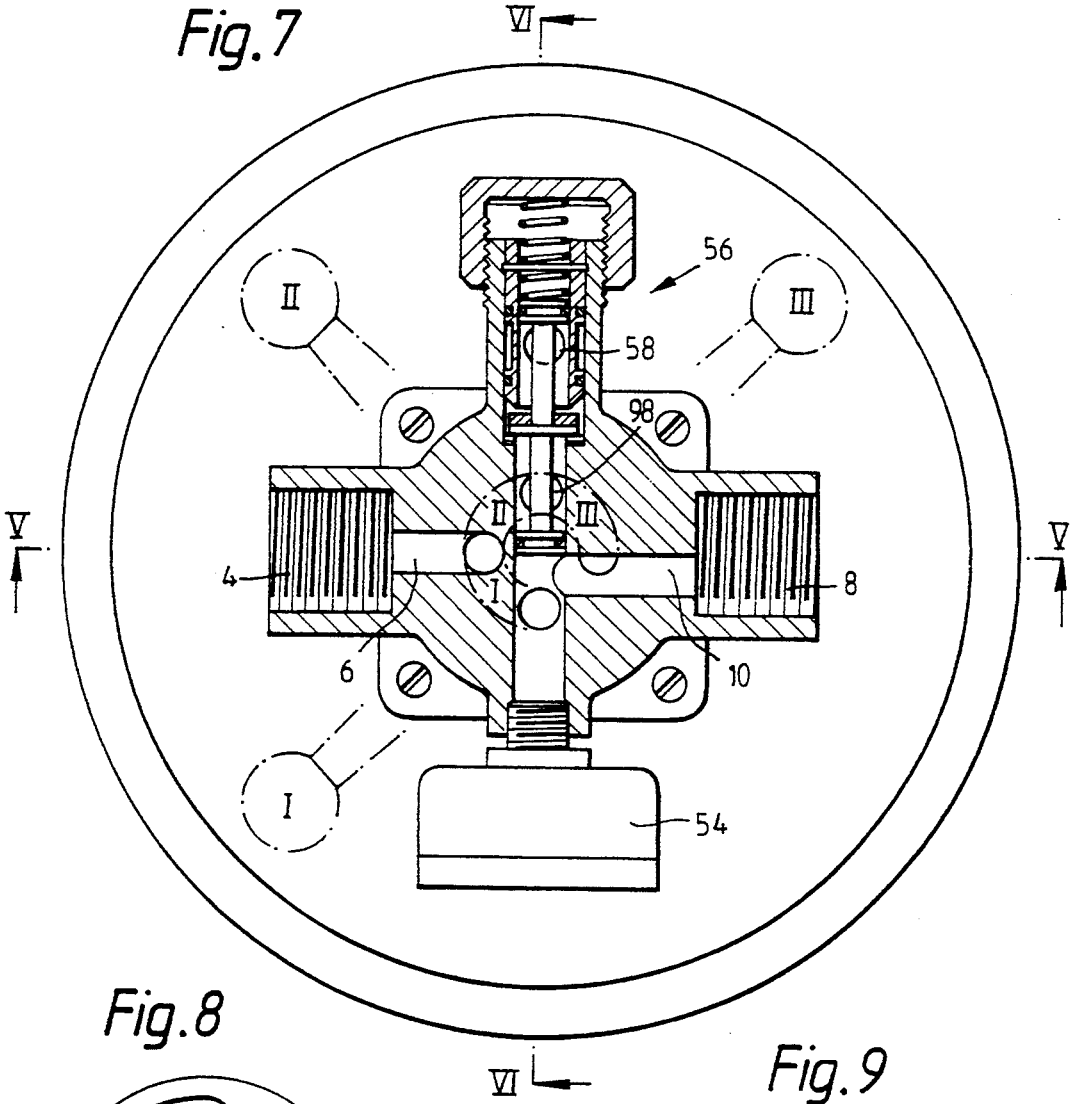
FIG. 7 is a top view, in cross-section along plane VII-VII of FIG. 5.

Additional components of the pressure booster according to this embodiment are visible in FIGS. 6 and 7.

There is seen a pressure gauge 54 communicating with the high-pressure outlet socket, by means of which the test pressure can be monitored, and a per se known pressure reduction valve 56, whereby, with a given mains pressure, the test pressure can be set to any magnitude below the maximum as determined by the ratio of diameters of the two piston portions.

From the outlet port 58 of the pressure reduction valve 56, a flexible hose serving as a feed duct 60 is seen to lead to a second, stroke-reversal valve 62, and from this valve 62 another flexible hose, serving as drain duct 64, is seen to lead-to the free atmosphere.

The stroke-reversal valve 62 is a per se known rotary-disk, 3-way, 2-position valve which is adapted to alternatingly connect the low-pressure inlet port via feed duct 60 with pressurizable chamber 29, thus producing the working stroke of the device, and the pressurizable chamber 29 with drain duct 64, thus permitting helical compression spring 50 to effect the return stroke.

The bistable stroke-reversal valve 62 (FIG. 6) comprises a valve body 68 to which flexible feed duct 60 and flexible drain duct 64 are connectable, as schematically indicated by the dash-dotted lines.

The valve body 68 is mounted on piston former 28 by means of a shouldered screw 70 and a metal washer 72. Two apertures 74 and 76, not seen in FIG. 6, but shown in FIG. 9, pass through piston former 28 and washer 70, leading to the (preferably Teflon) valve disk 78 pressed against washer 72 by means of disk spring 80. The apertures 74 and 76 communicate with feed duct 60 and drain duct 64, respectively.

Figure 9:
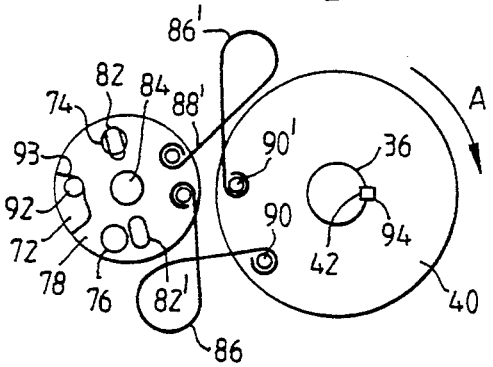
FIG. 9 is a schematic view of the snap-over mechanism of the second, bistable valve means.

As seen in the schematic representation of FIG. 9, valve disk 78 has two apertures 82 and 82', which communicate with chamber 29. The central hole 84 accommodates the body of screw 70, about which disk 78 pivots.

Further seen in FIG. 9 are two identical torsion springs 86, 86', one end 88, 88' of each which is pivoted to valve disk 78, and the other end 90, 90' to control sleeve 40. Springs 86, 86' are single-turn torsion springs, the two straight arms or limbs of each of which include in their nonstressed state an and of about 120°. As shown in FIG. 9, they are already stressed, spring 86' more so than spring 86. Also seen is the already-mentioned pin 94, which is affixed to control sleeve 40 and rides in helical groove 42 of guide pillar 36.

In the first stable state of the bistable stroke reversal valve 62 shown in FIG. 9, and after, in a precedure to be explained further below, the first rotary valve 44 has been properly positioned, aperture 74 which communicates with feed duct 60 is seen to register with aperture 82 of disk 78 and liquid at mains pressure is permitted to flow into chamber 29. This will cause rolling diaphragm 26, including piston former 28, hub member 32, control sleeve 40 and small-diameter piston 30 to move upwards, beginning its working stroke, at the same time compressing helical spring 50. The relative movement between control sleeve 40 and stationary guide pillar 36 thus produced, causes pin 94 to impart a rotary movement to control sleeve 40.

In the state shown in FIG. 9, both springs 86, 86', in their tendency to revert to their free state, exert on the valve disk 78 a torque acting in the counterclockwise direct-ion. Disk movement in this direction is limited by a stop pin 92 fixedly attached to the stationary washer 72, in conjunction with a recess in disk 78 producing two abutment faces 93, against the upper one of which pin 92 is seen to abut.

When now control disk 40 moves in direction of arrow A, the vector of the force exerted by springs 86, 86' will slowly change direction, with the effective torque arm, i.e., the normal from the center of disk 78 to the straight line connecting the two ends of each spring, being gradually reduced. As rotation of control sleeve 40 continues, there arrives the moment when this arm becomes zero (when the above-mentioned straight lines point towards the center of disk 78) and then increases again, but now generating a torque acting in the opposite, i.e., clockwise, direction, producing an inpulse which practically instantaneously flips valve disk 78 towards its second stable state (not indicated in FIG. 9), as defined by the stop pin 92 abutting against the lower abutment face 93. In this state, aperture 76, which communicates with drain duct 64, registers with aperture 82' of disk 78, thereby connecting the now liquid-filled chamber 29 with the atmosphere. This enables the compressed helical spring 50 to re-expand, forcing the piston system down again while expelling the liquid through drain duct 64.

While the torsion spring arrangement discussed above was found to be efficient, an over-center toggle arrangement using a helical spring would be equally useful.

After completion of the return or drain stroke, the stroke-reversal valve 62 flips again and the action is repeated until the required test pressure is achieved.

The parameters of the flipping action, such as the shape and strength of springs 86, 86' and the pitch of helical groove 42 which, at a given stroke length, determines the angular displacement of the control sleeves, are determined to such effect that flip-over occurs after the desired stroke length L (FIG. 5) has been completed.

Figure 8:
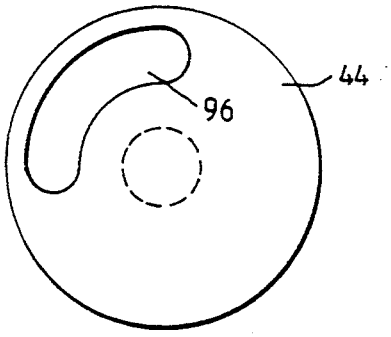
FIG. 8 is a bottom view of the valve plate of the first valve means.

Returning now to the first valve 44, its active face is shown in FIG. 8 and is seen to comprise an arcuate groove 96 that subtends an angle-of about 90. It is rotated by means of the handle and has three working positions (accurately defined by per se known detent means, not Shown) indicated in FIG. 7 by dash-dotted lines and Roman numerals I, II and III.

With handle 48 in position I, the arcuate groove 96 connects inlet socket 4 with outlet socket 8, thereby "priming", that is, filling, the object to be pressure-tested, which has been connected to outlet socket 8. The pressure gauge 54, seen in FIG. 7 to be connected to outlet socket 8, will now indicate the mains pressure.

In position II, communication is established between inlet socket 4 and feed duct 60 (via a bore 98, the pressure-reducing valve 56, and outlet port 58). Liquid now enters chamber 29 and, via groove 42 in guide pillar 36 and check valve 34, also the small-diameter portion 12 of the compound cylinder. As soon as all the air in the system has been driven out, the compound piston starts its strokes in the above-described manner, continuing until the required pressure has been reached, as indicated by pressure gauge 54. When the pressure reached is higher than that set by pressure-reducing valve 56, the latter will automatically stop the low-pressure liquid supply, thus preventing excessive pressure rises.

The principle of turning the relatively low mains pressure into a relatively high test pressure has been explained in conjunction with the first embodiment of the invention.

Once the required test pressure has been obtained, handle 48 is turned to position III, in which the system is isolated and remains under high pressure for the required test period.

To stop the test and relieve the pressure, the low-pressure supply is disconnected and handle 48 moved to position I, which, by connecting inlet and outlet sockets 4 and 8, facilitates pressure relief.

It will be appreciated that the terms "upper", "lower", "upwards", "downwards", etc., refer to the position of the device as shown in the drawings, which is also the preferred working position of the device.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A liquid pressure booster, comprising:

a head member with a low-pressure inlet connectable to a liquid source at mains pressure, a high-pressure outlet connectable to an object to be tested, and a central bore;

a compound cylinder constituted by a first, upper, relatively small-diameter portion fluid-tightly attached to said head member and a second, lower, relatively large-diameter portion contiguous with said upper portion and closed off at a lower end by a bottom plate having a drain opening;

a substantially hollow compound piston having two active portions: a first, relatively small-diameter portion fitting, and movable in, said first cylinder portion and adapted, when acting, to produce a relatively high pressure, and a second, relatively large-diameter portion, contiguous with said first portion, fitting, and movable in, said second cylinder portion, and adapted to be acted upon by a relatively low pressure;

a central, at least partly hollow, valving bar actuatable from outside of said head member and movable in reciprocating translation between a first and a second position;

a bistable valving sleeve slidably seated on said valving bar and movable in reciprocating translation between a first and a second position;

first spring means for biasing said compound piston towards said bottom plate;

second spring means for producing a snap-action impulse causing said bistable valving sleeve, in dependence of, and in coordination with, the movement of said compound piston, to alternate between said first and said second positions.

2. The pressure booster as claimed in claim 1, wherein said valving bar is provided with two non-communicating axial bores, each provided with openings connecting these bores with an outer surface of said bar to the effect of providing, in dependence on the relative positions of said valving bar and said valving sleeve, a passageway for said liquid from said low-pressure inlet into the hollow of said compound piston, respectively providing a passageway for said liquid from said hollow via said drain opening into the atmosphere.

3. The pressure booster as claimed in claim 1, wherein said first portion of said compound piston is provided with a check valve permitting liquid flow from the hollow of said compound piston into said first portion of said compound cylinder, but preventing liquid flow from said first portion of said compound cylinder into said hollow of said compound piston.

4. The pressure booster as claimed in claim 1, wherein said valving sleeve is provided with an internal peripheral recess and with a plurality of port openings connecting said recess with the outside surface of said sleeve.

5. The pressure booster as claimed in claim 1, wherein said head member comprises a port opening leading from said low-pressure inlet into said central bore, a port opening leading from said high-pressure outlet into said central bore, and a duct leading, upon essembly, from said high-pressure outlet into said first portion of said compound cylinder.

6. A liquid pressure booster, comprising:

a head member with a low-pressure inlet socket connectable to a liquid source at mains pressure, and a high-pressure outlet socket connectable to an object to be tested;

a compound cylinder constituted by a first, relatively small-diameter portion and a second, two-part, relatively large-diameter portion, the upper one of said two parts carrying said head member to which said first, small-diameter portion is tightly attached, the lower one of said two parts having a bottom surface;

a compound piston constituted of two active portions: a first, substantially hollow, relatively small-diameter portion fitting, and slidable in, said first cylinder portion, and a second, relatively large-diameter portion movable in said second-cylinder portion, with the large-diameter piston portion dividing said second, large-diameter cylinder portion into a pressurizable chamber on the one hand, and into a vented chamber communicating with the atmosphere, on the other;

first valve means located on top of said head member and having at least two discrete, optional positions, in the first of which positions said first valve means connects said low-pressure inlet socket via said high-pressure outlet with said object to be pressure-tested to the exclusion of said compound cylinder, and in the second of which positions said first valve means connects said low-pressure inlet socket with said pressurizable chamber;

second, bistable valve means mounted on said large-diameter portion of said compound piston and flippable between a first position and a second position;

first flexible ducting means connecting said low-pressure inlet socket with an inlet port of said second valve means, and second flexible ducting means connecting an outlet port of said second valve means with the atmosphere.

7. The pressure booster as claimed in claim 6, wherein said large-diameter portion of said compound piston is a rolling diaphragm fixedly attached at a central region to a rigid, cup-shaped piston former and tightly clamped at its periphery between said two parts of said large-diameter cylinder piston.

8. The pressure booster as claimed in claim 6, wherein said first valve means has a third discrete position in which said first valve means prevents communication between said low-pressure inlet socket and said second valve means.

9. The pressure booster as claimed in claim 6, further comprising first check valve means permitting liquid flow from said pressurizable chamber via the hollow of said first piston portion into the first portion of said compound cylinder, but prevents liquid flow in the opposite direction, and a second check valve permitting liquid flow from said first cylinder portion via said high-pressure outlet socket into said object to be pressure-tested, but prevents liquid flow in the opposite direction.

10. The pressure booster as claimed in claim 6, further comprising a guide pillar fixedly attached to the bottom surface of said large-diameter portion of said compound cylinder, said guide pillar slidingly fitting a control sleeve adapted to flip said second valve means between said two positions and mounted in a hub member with one degree of freedom in rotation relative thereto, said hub member being fixedly connected to said cup-shaped piston former.

11. The pressure booster as claimed in claim 10, wherein said control sleeve carries a pin engaging in a helical groove provided in said guide pillar, to the effect that when said control sleeve is linearly moved along said guide pillar due to the linear displacement of said compound piston, said pin imparts to said control sleeve an angular movement superposed on said linear movement.

12. The pressure booster as claimed in claim 10, further comprising at least one two-armed torsion spring, one arm of which is pivoted at its end to a rotary valve disk of said bistable valve means, the other being pivoted to said control disk, all in such a way that, after said control sleeve has been angularly displaced beyond a-certain point, said spring will snap through from a first state of higher stresses to a second state of lower stresses, flipping said second valve means from said first position to said second position.

13. The pressure booster as claimed in claim 6, further comprising adjustable pressure reducing means located upstream of said high-pressure outlet socket, whereby, with a given mains pressure, the pressure applied to said object to be tested can be set to any magnitude lower than the maxiumum as determined by the ratio of diameters of one or both of said two piston portions and said two cylinder portions.

14. The pressure booster as claimed in claim 6, further comprising spring means for biasing said compound piston towards said bottom surface.

* * * * *